United States Patent [19]

Sturdevan

[11] Patent Number: 4,810,198

[45] Date of Patent: Mar. 7, 1989

[54] REINFORCED BOOT FOR SPARK PLUG CABLES

[75] Inventor: Ronald P. Sturdevan, Tifton, Ga.

[73] Assignee: Prestolite Wire Corporation, Farmington Hills, Mich.

[21] Appl. No.: 120,940

[22] Filed: Nov. 13, 1987

[51] Int. Cl.[4] ..... H01R 13/516

[52] U.S. Cl. ..... 439/125; 439/278

[58] Field of Search ..... 174/77 S, 138 S, 31 S; 123/143 C, 169 P, 169 PA, 169 PH; 313/135; 439/125–128, 278, 279, 281–283, 587–589, 731, 750

[56] References Cited

U.S. PATENT DOCUMENTS

| | | | |
|---|---|---|---|
| 3,803,529 | 4/1974 | Rohrig et al. | 439/126 |
| 4,497,532 | 2/1985 | Bezusko et al. | 439/607 |
| 4,671,586 | 6/1987 | DeBolt | 439/126 |

*Primary Examiner*—Gary F. Paumen

*Attorney, Agent, or Firm*—Remy J. VanOphem

[57] ABSTRACT

A rigid shell surrounding a spark plug cable elastomer boot for giving columnar strength thereto as an aid for installation and removal of its associated spark plug cable in relation to a spark plug. In a first preferred embodiment, an elastomer boot is surrounded by a rigid shell, where the rigid shell is held in fixed relation to the elastomer boot by an interlocking relationship between an annular flange on the upper end of the elastomer boot and a plurality of axially aligned ribs on the lower end of the elastomer boot. In a second preferred embodiment, a flange is provided at the upper end of the elastomer boot which interlocks between a cup on the upper end of the rigid shell and a cap snapped onto the cup. In a third preferred embodiment, the second preferred embodiment is modified to include a plurality of axially aligned ribs on the lower end of the elastomer boot, as well as including an interlocking relationship between retainer nibs on the elastomer boot and retainer apertures on the rigid shell.

5 Claims, 3 Drawing Sheets

REINFORCED BOOT FOR SPARK PLUG CABLES

BACKGROUND OF THE INVENTION

1. Field of the Invention

This invention relates to spark plug cable insulators, particularly a spark plug boot having a rigid shell for adding structural strength to an elastomer boot used to protect the connection between a spark plug cable terminal and a spark plug.

2. Description of the Prior Art

Conventional spark plug cables are very flexible in order to permit a mechanic to run spark plug cables from a spark plug to a distributor in a convenient manner. This flexibility, however, results in occasional difficulty for the mechanic who is attempting to seat the spark plug cable terminal onto the spark plug. Particularly, this problem arises when the spark plug is in a somewhat inaccessible area in the engine compartment, or when the spark plug is located within a well of the engine block. The common practice in the art of using an elastomer boot attached to the end of the spark plug cable for covering the spark plug cable terminal and a received spark plug only exasperates the aforementioned problem of installation difficulty. This is because the boot is also flexible and the tight fit between the boot and the spark plug frequently results in a false sensation that a properly seated connection with the spark plug has been achieved, when in fact this is not the case.

An additional problem arises with conventional spark plug cable systems, in that removal of the spark plug cable from the spark plug is frequently difficult. This is because the elastomer boot tends to seal onto the spark plug, creating both suction and adhesion. In situations of limited accessibility, the mechanic frequently chooses to pull on the spark plug cable a considerable distance away from the spark plug terminal, causing fatigue to the electrical connections within the spark plug cable.

There have been a number of attempts in the prior art to devise a successful spark plug cable connection system.

One class of spark plug cable connection systems involves spark plug cable terminal protectors where the terminal is bent at an angle of 90° relative to the spark plug.

U.S. Pat. No. 1,245,931 to Lanman, is directed to the problem of a spark plug being subject to injury from falling objects and water short circuiting. Lanman solves this problem by providing an L-shaped metal sheath which clamps to both the spark plug cable and the spark plug.

U.S. Pat. No. 1,376,844 to Weber, is directed to the problem of making good electrical contact between the spark plug and the spark plug cable. Weber solves this problem by providing an L-shaped insulator having at one end the spark plug cable and at the other end an aperture into which the spark plug inserts, thereby making contact with the spark plug cable terminal.

U.S. Pat. No. 2,301,570 to Nowosielski, is directed to the problem of difficulty of making good mechanical and electrical connection of spark plug cables to spark plugs, as is required in aircraft engines. Nowosielski solves this problem by providing an electromagnetic shield, a cover, a wire piercing element, an insulator, and bushing for the spark plug cable to pass through. The bushing coupled with the cover is designed to be permanently attached to the spark plug, and is not independent of the spark plug cable.

U.S. Pat. No. 2,323,399 to Jacobi, is directed to the problem of electromagnetic wave propagation from spark plug terminals. Jacobi solves this problem by using a shield composed of two layers; an inner rubber shield and an outer conductive rubber shield.

U.S. Pat. No. 2,382,805 to Mosthaf, is directed to the problems encountered in aircraft engine operating environments. Mosthaf solves these problems by providing a sheathing of kiln fired ceramic over the spark plug cable and the spark plug upper end.

U.S. Pat. No. 2,686,511 to Platner, is directed to the problem of spark plug terminal shields being blown off during engine operation. Platner solves this problem by providing a cover over the spark plug. A steel shield within the cover has axially positioned therein the spark plug cable which is covered by a ceramic.

U.S. Pat. No. 4,443,047 to Hofmann, is directed to the problem of the spark plug terminal becoming deformed during removal from the spark plug. Hofmann solves this problem by providing a two-piece L-shaped boot covering. The boot covering conforms to the already present shape of the boot and the direction of the spark plug cable and supplies a handhold to aid removal from the spark plug.

A second class of spark plug cable connection systems involves protectors for spark plug cable terminals which are straight (that is, 180°) in relation to the spark plug.

U.S. Pat. No. 2,685,872 to Berstler, is directed to the problem of electrical leakage from spark plugs. Berstler teaches that this can be solved by using a two part insulator surrounding the spark plug components. Specifically, his teachings are directed to an improved type of spark plug, wherein a base insulator is made of a machinable material and an upper insulator is made of a cheaper type of insulator material.

U.S. Pat. No. 3,076,113 to Candelise, is directed to the problem of loss of dielectric effectiveness of the spark plug cable boots over time. Candelise solves this problem by providing, interior to the spark plug itself, the spark plug cable terminal. A protective rubber boot is also provided.

U.S. Pat. No. 3,128,139 to Estes, is directed to the problem of electromagnetic waves emanating from the spark plug. Estes teaches that this problem may be solved by providing a metallic shield over the spark plug cable terminal attachment area.

U.S. Pat. No. 3,803,529 to Rohrig et al, is directed to the problems associated with spark plug terminals in which moisture and conductor kinking can occur. Rohrig et al solve these problems by providing two insulating layers. One is a body and the other is a casing, where both are made of a thermal setting material. An elastomeric material fills in any gaps therebetween. An end portion is made a metal shield.

U.S. Pat. No. 3,914,003 to Loy, is directed to the problem of the interior of the spark plug terminals becoming brittle and deteriorating over time. Lay solves this problem by providing an exterior thermal setting plastic and an interior elastomeric plastic. Lay surrounds the upper extremity of the spark plug with the thermal setting plastic, using the elastomeric plastic to protect only the spark plug cable conductors.

U.S. Pat. No. 4,621,881 to Johansson et al, is directed to the problem of prior art elastomer boots being of a size which causes a tight fit with the spark plug, resulting in difficulty during removal therefrom. Johansson et al solve this problem by providing a stiff material which surrounds an elastomeric material. The elastomeric material extends between the upper end of the spark plug to the beginning of the spark plug cable, but is not co-extensive with the spark plug cable. The outer material combines with the inner material only for sealing purposes.

Devices have been developed to protect electrical connections by means of a shield against both operational and environmental problems.

U.S. Pat. No. 3,845,459 to Normann, is directed to the problem of female sockets suffering from dielectric breakdown and mechanical fatigue from insertion of oversized male connectors. Normann solves this problem by providing a bridged insulator which surrounds the female electrical connector. A suggested material is Teflon®. This invention, through not specifically directed to spark plug wires, is of interest for showing a rigid dielectric covering over the electrical contact.

U.S. Pat. No. 4,614,392 to Moore, is directed to the problem of protecting an electrical connection from well fluids. Moore solves this problem by providing an elastomer cover which snaps together. The covering has an outer protective skin.

None of the above cited references teach a solution to the spark plug accessibility problems enumerated above. Accordingly, there remains in the art the need to provide a rigid shell for adding structural strength to elastomer boots so as to permit easy accessibility to remotely located spark plugs.

SUMMARY OF THE INVENTION

Provided is a reinforced boot for a spark plug cable and a spark plug cable terminal electrically and mechanically attached to the spark plug cable. An elastomer boot is circumscribed by the rigid shell for giving columnar strength to the elastomer boot. The elastomer boot has a central bore which has a first portion structured to receive the spark plug cable terminal and a predetermined portion of the spark plug cable. The central bore further has a second portion which is structured to receive a spark plug. The rigid shell is held in fixed circumscribed relation with the elastomer boot by an interfering structural interrelationship between the elastomer boot and the rigid shell.

Accordingly, it is an object of the invention to provide a spark plug boot having a rigid shell for surrounding an elastomer spark plug cable boot giving columnar strength thereto and thereby providing ease of attachment of its associated spark plug cable terminal to a spark plug.

It is a further object of the invention to provide an interlocking relationship between a rigid shell and an elastomer boot over which it is placed, so as to maintain a mutually fixed relationship therebetween.

It is yet a further object of the invention to provide a rigid shell for a spark plug cable boot which includes a handle for providing ease of removal of the elastomer boot and its associated spark plug cable terminal from a spark plug.

These and other objects, advantages, features and benefits of the invention will become apparent from the following specification.

DETAILED DESCRIPTION OF THE PREFERRED EMBODIMENT

Figure 1:
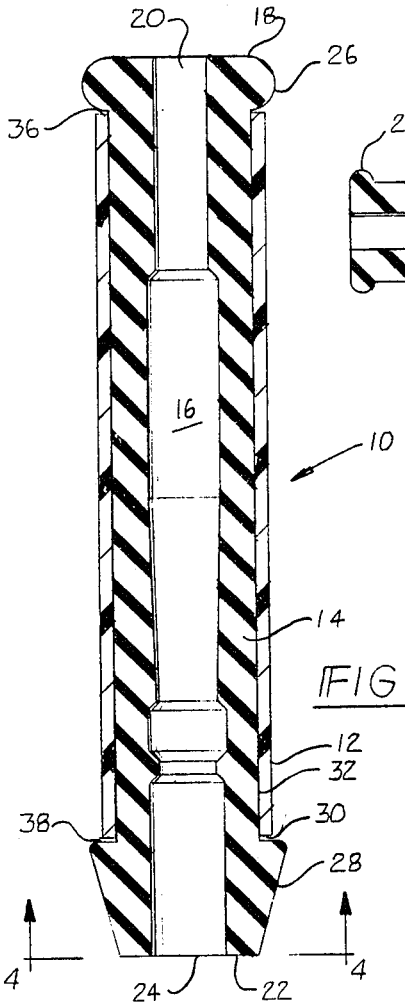
FIG. 1 is a sectional side view of the first preferred embodiment of the invention.

Referring now to the figures, FIG. 1 shows the first preferred embodiment 10 of the reinforced boot for spark plug cables, where a rigid shell 12 surrounds an elastomer boot 14.

Figure 2:
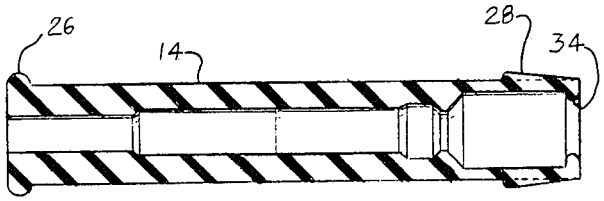
FIG. 2 is a sectional view of the elastomer boot according to the first embodiment of the invention.
Figure 3:
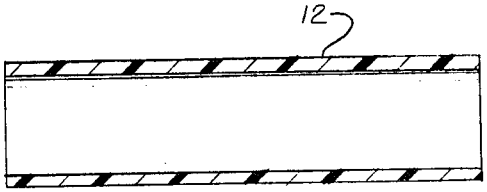
FIG. 3 is a sectional view of the rigid shell according to the first embodiment of the invention.

The elastomer boot 14 is generally cylindrical and made from an elastomer material, such as silicone rubber. A central bore 16 extends through the elastomer boot. At an uppermost end 18 of the elastomer boot, the central bore forms a first aperture 20 for receiving a spark plug cable. At the lowermost end 22 of the elastomer boot, the central bore forms a second aperture 24 for receiving a spark plug. At the uppermost end 18 of the elastomer boot, an integral annular rim 26 is provided which extends radially away from the central bore 16. At the lowermost end 22 of the elastomer boot, a plurality of integral axially aligned ribs 28 are provided. Each of the axially aligned ribs 28 is preferred to conically taper toward the lowermost end 22 of the elastomer boot from an initial point 30 which radially juts out from a surface 32 of the elastomer boot 14. FIG. 2 shows the elastomer boot including an annular nib 34 at its lowermost end for aiding in sealing of the elastomer boot with respect to a spark plug.

The rigid shell 12 is generally cylindrical and made of a rigid material, such as heat stabilized nylon. The inner diameter of the rigid shell is just slightly larger than the outer diameter of the elastomer boot, so that when the rigid shell is slid onto the elastomer boot, a snug fit is thereby produced. Further, the length of the rigid shell is just slightly less than the distance between an inner radial surface 36 of the annular rim 26 and an inner radial surface 38 at the initial point 30 of the axially aligned ribs 28. As a consequence, the rigid shell circumscribes the elastomer boot and fits snugly and fixedly between the radial surfaces 36 and 38.

The first preferred embodiment 10 is assembled by sliding the rigid shell onto the elastomer boot. The rigid shell 12 is slid over the elastomer boot 14 by introducing one end of the rigid shell to the lowermost end 22 of the elastomer boot, then pushing the rigid shell onto the elastomer boot. This is possible because of the flexibility of the elastomer boot which permits the axially aligned ribs 28 to deform sufficiently to allow the rigid shell to slide onto the elastomer boot. A lubricant can be used to facilitate sliding the rigid shell onto the elastomer boot.

Figure 4:
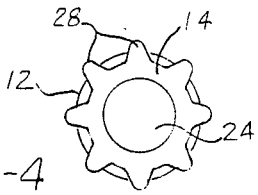
FIG. 4 is an end view of the first preferred embodiment of the invention as seen along lines 4—4 of FIG. 1.

FIG. 4 is an end view, showing the axially aligned ribs 28 of the elastomer boot 14, the second aperture 24 and the rigid cylindrical shell 12.

Figure 5:
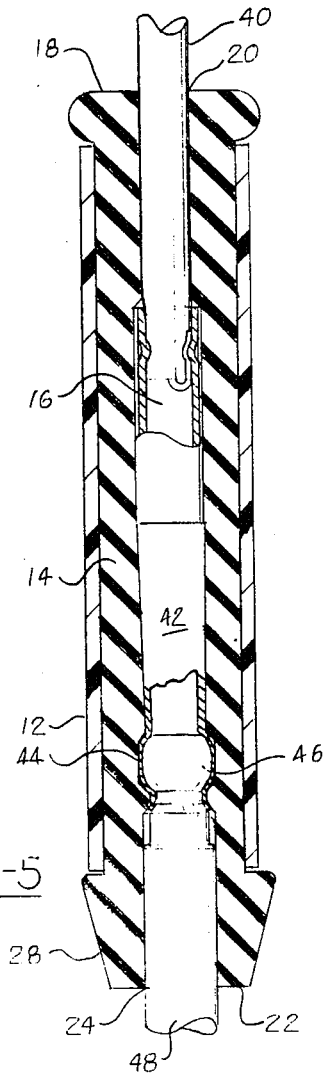
FIG. 5 is a part sectional view of the invention of FIG. 1 in operation.

FIG. 5 shows the first preferred embodiment 10 in an assembled configuration and mounted to a spark plug 48. A spark plug cable 40 enters into the elastomer boot 14 through the first aperture 20. The spark plug cable 40 is mechanically and electrically connected to a spark plug terminal 42. The spark plug terminal has, in turn, an electrically conductive clip 44 structured for slipping over a tip 46 of the spark plug 48. The spark plug 48 is shown in the figure having entered into the elastomer boot 14 through the second aperture 24. Thus, the central bore 16 at a first portion thereof receives the spark plug cable terminal 42 and a portion of the spark plug cable 40. The portion of the spark plug cable is determined by the length of the upper portion of the elastomer boot in relation to the length of the spark plug cable terminal. Further, the central bore 16 at a second portion thereof receives the spark plug 48 at its tip 46. In operation, a mechanic simply grabs hold of the rigid shell at a convenient location thereon and pushes to attach the spark plug cable terminal onto the spark plug, or pulls to detach the spark plug cable terminal from the spark plug. Because of the interlocking relationship between the radial surfaces 36 and 38 of the elastomer boot in relation to the rigid shell, the rigid shell will remain in fixed relation relative to the elastomer boot during both attachment and removal operations.

Figure 6:
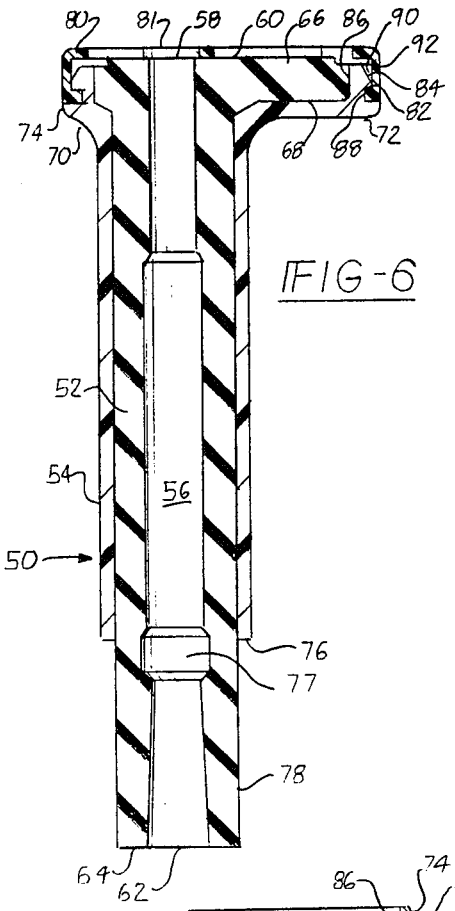
FIG. 6 is a sectional side view of the second preferred embodiment of the invention.

FIG. 6 shows a second preferred embodiment 50 of the reinforced boot for spark plug cables, where, in like fashion of the first preferred embodiment 10, an elastomer boot 52 is surrounded by a rigid shell 54.

Figure 7:
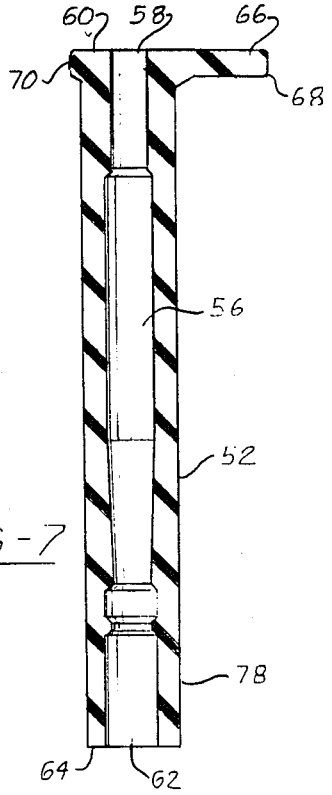
FIG. 7 is a sectional side view of the elastomer boot according to the second preferred embodiment of the invention.

With reference to FIG. 7, as in the first preferred embodiment 10, there is a central bore 56 in the elastomer boot. The central bore 56 serves the same function as described above for the first preferred embodiment, forming a first aperture 58 at an uppermost end 60 of the elastomer boot and also forming a second aperture 62 at a lowermost end 64 of the elastomer boot. The elastomer boot 52 has no axially aligned ribs. The annular rim 26 of the first preferred embodiment 10 is also deleted and substituted therefor is a flange 66. The flange 66 has a curvilinear shape, having one portion 68 which radially projects a distance significantly greater than that of the remaining portion 70 thereof, because the first aperture 58 is offset in relation to the geometric center of the flange.

Figure 8:
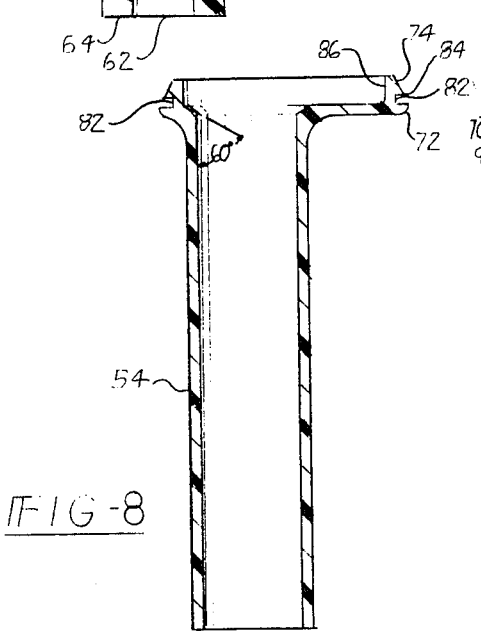
FIG. 8 is a sectional side view of the rigid shell according to the second embodiment of the invention.

As illustrated in FIGS. 6 through 8, the rigid shell 54, as in the first embodiment of the invention 10, is structured to snugly fit over the elastomer boot 52. The rigid shell 54 has a cup 72 at its upper end 74 which is structured to snugly fit around the flange 66 of the elastomer boot 52. The rigid shell 54 is not as long axially as is the elastomer boot 52, so that when the rigid shell is in place over the elastomer boot, it is truncated at a location 76 substantially adjacent the spark plug cable terminal connection point 77 to a spark plug, as defined above in the first preferred embodiment 10. This leaves a lower portion or free end 78 of the elastomer boot 52 free from enclosure by the rigid shell 54 and, consequently, free to engage an inserted spark plug through the second aperture 62. It will be seen from FIG. 6 that the rigid shell may be easily slid onto the elastomer boot when the rigid shell is introduced to the elastomer boot at the lowermost end 64 thereof.

Figure 9:
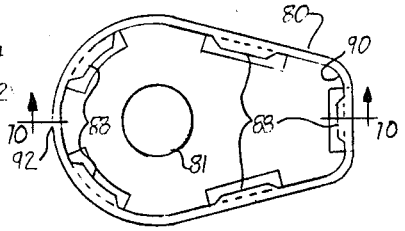
FIG. 9 is a bottom view of the cap according to the second preferred embodiment of the invention.
Figure 10:
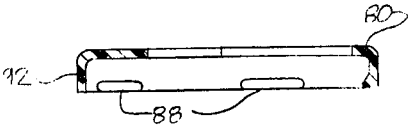
FIG. 10 is a sectional side view of the cap along lines 10—10 of FIG. 9.

A cap 80 is provided which is dimensioned to completely cover the cup 72 when the cap 80 is snapped onto the cup. An aperture 81 is provided in the cap 80 to allow the spark plug cable to pass through out of the first aperture 58 of the elastomer boot 52. The snap fit which holds the cap 80 to the cup 72 is provided by a plurality of slots 82 on an outer surface 84 of a side wall 86 of the cup 72 which interlock with a similarly numbered and correspondingly located plurality of nibs 88 on an inner surface 90 of a side wall 92 of the cap 80. FIGS. 9 and 10 particularly show the cap as heretofore described. The cap 80 is snapped onto the rigid shell 54 after the rigid shell has been slid over the elastomer boot 52. Because the flange 66 of the elastomer boot 52 is trapped between the cup 72 of the rigid shell 54 and the cap 80, the elastomer boot 52 is held in fixed relation to the rigid shell during spark plug installation and removal operations as described above for the first preferred embodiment 10.

Figure 11:
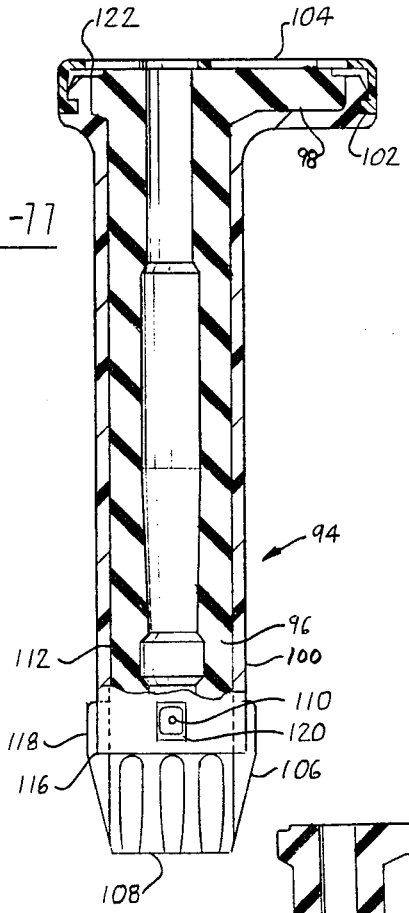
FIG. 11 is a part sectional side view of the third preferred embodiment of the invention.
Figure 12:
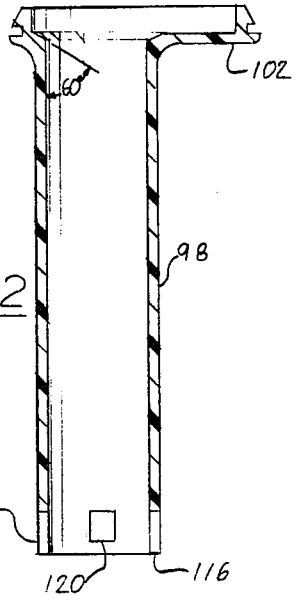
FIG. 12 is a sectional side view of the rigid shell according to the third preferred embodiment of the invention.
Figure 13:
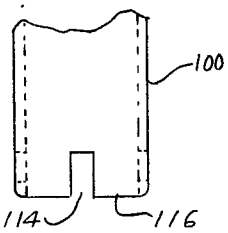
FIG. 13 is a part sectional side view of the lowermost end of the rigid shell in FIG. 12.
Figure 14:
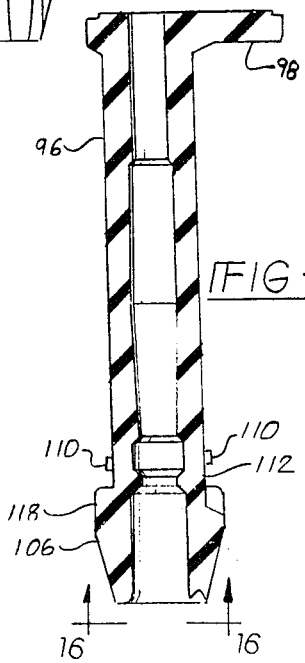
FIG. 14 is a sectional side view of the elastomer boot according to the third preferred embodiment of the invention.
Figure 15:
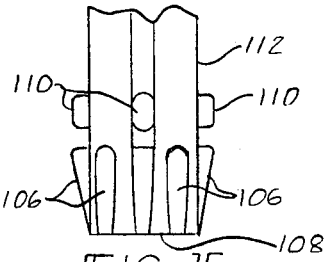
FIG. 15 is a side view of the lowermost end of the elastomer boot in FIG. 14.
Figure 16:
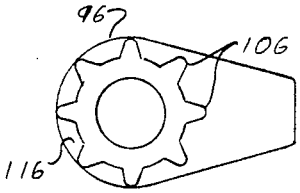
FIG. 16 is bottom view of the third preferred embodiment of the invention as seen along lines 16—16 in FIG. 14.

FIG. 11 shows a third preferred embodiment 94 of the reinforced boot for spark plug cables, where, as in the second preferred embodiment 50, an elastomer boot 96 having a flange 98 is surrounded by a rigid shell 100 having a cup 102. Thus, in the third preferred embodiment, the structures of the cup and flange correspond exactly to those of the second embodiment. A cap 104, which also structurally corresponds to that of the cap in the second preferred embodiment 50, snap fits onto the cup 102 in the same manner as described for the second preferred embodiment 50. In either the second or third embodiments, the cap can alternatively be permanently secured to the cup by gluing, sonic welding or any other fastening means known in the art.

As can be seen from FIG. 11, the essential difference between the second and third preferred embodiments concerns structural variation in the free end 78 of the second preferred embodiment. Hereat the third preferred embodiment 94 incorporates in part the teachings of the first preferred embodiment 10, in which a plurality of axially aligned ribs 106 are located adjacent a lowermost end 108 of the elastomer boot 96, in the same manner described hereinabove for the first preferred embodiment 10. In addition to the plurality of axially aligned ribs 106, a plurality of retainer nibs 110 are located on the outer surface 112 of the elastomer boot 96. The rigid shell 100 has a plurality of slots 114 in its lowermost end 116 which are structured to receive the axially aligned ribs 106. As can be seen from FIG. 11, the rigid shell 100 of the third preferred embodiment 94, unlike the rigid shell 12 of the first preferred embodiment 10, is of a length that includes an upper portion 118 of the axially aligned ribs 106. Further, a plurality of retainer apertures 120 are provided on the rigid shell. The retainer apertures are positioned to be in a corresponding relationship with the plurality of retainer nibs 110 provided on the elastomer boot 96, so that when the rigid shell 100 is in place on the elastomer boot 96, each retainer aperture 120 receives a retainer nib 110. As in the first preferred embodiment 10, the axially aligned ribs give added strength to the elastomer boot. The interlocking relationship between the retainer apertures 120 and the retainer nibs 110 is in addition to the interlocking relationship between the flange and the combination of the cup and the cap to provide added resistance to relative movement between the elastomer boot 96 and the rigid shell 100 during spark plug installation and removal operations, as described above. FIGS. 11 through 16 show in detail the third preferred embodiment 94, as hereinbefore described.

Installation of the rigid shell 100 onto the elastomer boot 96 is accomplished by introducing the rigid shell, at its uppermost end 122, to the elastomer boot 96, at its lowermost end 108. As in the assembly procedure for the first preferred embodiment 10, the elastomer boot 96 is sufficiently elastic so that the axially aligned ribs 106 and the retainer nibs 110 deform in response to the insertion of the elastomer boot 96 into the rigid shell 100. Again, a lubricant can be used to facilitate slipping the rigid shell over the elastomer boot.

Each of the first, second and third embodiments of the invention can include structure described with any one of the other embodiments. For instance, the structure of the lower end of the third preferred embodiment 94 could be substituted for the structure of the lower end of the first preferred embodiment 10.

To those skilled in the art to which this invention appertains, the above described preferred embodiments may be subject to change or modification. Such changes or modifications can be carried out without departing from the scope of the invention, which is intended to be limited only by the scope of the appended claims.

What is claimed is:

1. A reinforced boot for a spark plug cable and a spark plug cable terminal electrically and mechanically connected to said spark plug cable, comprising:

a generally cylindrical elastomer boot having an annular rim provided at one end, and a plurality of radially extending ribs having radially extending surfaces provided at the other end, said elastomer boot further having a central bore having a first portion structured to receive said spark plug cable terminal and a predetermined portion of said spark plug cable and a second portion structured to receive a spark plug; and a generally cylindrical rigid shell circumscribing said elastomer boot between said annular rim and said plurality of radially extending ribs to give columnar strength to said elastomer boot, one end of said rigid shell engaging a radial surface of said annular rim and the other end engaging said radially extending surfaces of said plurality of radially extending ribs, thereby trapping said rigid shell therebetween.

2. A reinforced boot for a spark plug cable and a spark plug cable terminal electrically and mechanically connected to said spark plug cable, comprising:

a generally cylindrical elastomer boot having at one end an annular rim and at the other end at least one rib, said elastomer boot further having a central bore, said central bore having a first portion structured to receive said spark plug cable terminal and a predetermined portion of said spark plug cable, said central bore further having a second portion structured to receive a spark plug; and a rigid shell circumscribing said elastomer boot and trapped between said annular rim and said at least one rib to give columnar strength to said elastomer boot.

3. The reinforced boot of claim 2, wherein said at least one rib is a plurality of ribs which are axially aligned parallel with said central bore.

4. The reinforced boot of claim 3, further comprising:

said spark plug cable terminal and said predetermined portion of said spark plug cable being received by said first portion of said central bore, said spark plug cable terminating within said central bore in said spark plug cable terminal, said second portion of said central bore being structured to permit said spark plug to enter said central bore and electrically connect with said spark plug cable terminal.

5. A reinforced boot for a spark plug cable and a spark plug cable terminal electrically and mechanically connected to said spark plug cable, comprising:

a generally cylindrical elastomer boot having at one end an annular rim and at the other end at least one rib, said elastomer boot further having a central bore, said central bore having a first portion retaining said spark plug cable terminal and a predetermined portion of said spark plug cable, said central bore further having a second portion structured to receive a spark plug; and a rigid shell circumscribing said elastomer boot between said annular rim and said at least one rib, said annular rim and said at least one rib trapping said rigid shell therebetween so as to provide columnar strength to said elastomer boot.

* * * * *

UNITED STATES PATENT AND TRADEMARK OFFICE

CERTIFICATE OF CORRECTION

PATENT NO. : 4,810,198

DATED : March 7, 1989

INVENTOR(S) : Ronald P. Sturdevan

It is certified that error appears in the above-identified patent and that said Letters Patent is hereby corrected as shown below:

Column 2, Line 61, delete "Lay" and insert ---- Loy ----.

Column 2, Line 63, delete "Lay" and insert ---- Loy ----.

Column 3, Line 20, delete "through" and insert ---- though ----.

Column 4, Line 36, after "is" insert ---- a ----.

Signed and Sealed this

Twenty-third Day of April, 1991

*Attest:*

HARRY F. MANBECK, JR.

*Attesting Officer*

*Commissioner of Patents and Trademarks*